US011723459B2

(12) United States Patent
Lizardi Alvarez

(10) Patent No.: US 11,723,459 B2
(45) Date of Patent: Aug. 15, 2023

(54) SHELF SYSTEM FOR A BEVERAGE CABINET

(71) Applicant: ELECTROLUX HOME PRODUCTS, INC., Charlotte, NC (US)

(72) Inventor: Victor Jose Lizardi Alvarez, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 163 days.

(21) Appl. No.: 17/307,148

(22) Filed: May 4, 2021

(65) Prior Publication Data

US 2022/0354250 A1 Nov. 10, 2022

(51) Int. Cl.
*A47B 73/00* (2006.01)
*F25B 49/02* (2006.01)

(52) U.S. Cl.
CPC ..... *A47B 73/00* (2013.01); *F25B 49/02* (2013.01)

(58) Field of Classification Search
CPC ..... A47B 73/00; F25B 49/02
See application file for complete search history.

(56) References Cited

U.S. PATENT DOCUMENTS 5,797,501 A * 8/1998 Von Gunten ..... A47B 57/42 211/183
10,485,339 B2 * 11/2019 Hao ..... A47B 73/008
10,820,725 B1 * 11/2020 Fagundes ..... A47B 73/008
2004/0245200 A1 * 12/2004 Jersey ..... A47B 81/007 211/175
2007/0228909 A1 * 10/2007 Hwang ..... F25D 31/007 312/408

(Continued)

FOREIGN PATENT DOCUMENTS

CN 103960883 A 8/2014
EP 1816418 A2 8/2007
EP 2549213 A2 1/2013

(Continued)

OTHER PUBLICATIONS

My Wine Cabinet, Sliding Tray for Vertical Bottles Storage: REF.: ACI-DOM594, https://www.my-wine-cabinet.com/sliding-tray-for-vertical-bottles-storage-dometic-art3862.htm.

(Continued)

*Primary Examiner* — Henry T Crenshaw
(74) *Attorney, Agent, or Firm* — Moore & Van Allen PLLC; R. W. McCord Rayburn

(57) ABSTRACT

Beverage cabinets and shelf systems for beverage cabinets are described herein. The present invention may include a cabinet that includes a housing, a door attached to a front edge of the housing, and shelves suspended within the interior of the housing by rail mechanisms. One or more of the shelves may include a rear support extending approximately from left to right in a rear portion of interior of the housing, a transverse support extending approximately from left to right and offset from the front edge of the housing, and medial supports extending approximately from front to back. One or more of the medial supports may include a back portion extending from the rear support to the transverse support and a front portion extending from the transverse support to the front edge of the housing, where the front portion is removable.

23 Claims, 12 Drawing Sheets

(56) References Cited

U.S. PATENT DOCUMENTS

| | | | | |
|---|---|---|---|---|
| 2009/0230137 | A1* | 9/2009 | Rivier | F25D 31/007 417/44.1 |
| 2015/0069000 | A1* | 3/2015 | Rosen | A47F 5/01 211/186 |

FOREIGN PATENT DOCUMENTS

| | | | |
|---|---|---|---|
| JP | 2008008610 | A | 1/2008 |
| WO | 2003023295 | A2 | 3/2003 |
| WO | 2004090444 | A1 | 10/2004 |
| WO | 2007090713 | A2 | 8/2007 |
| WO | 2010123177 | A1 | 10/2010 |
| WO | 2012130573 | A2 | 10/2012 |
| WO | 2020099004 | A1 | 5/2020 |

OTHER PUBLICATIONS

Eurocave Professional, Tasting Sliding Shelf, 6000 Series & Collection Range, https://www.eurocavepro.com/accessories/372-tasting-sliding-shelf-5000-series-collection-range.html.

Eurocave, Accessories: Service option—Light oak Main du Sommelier ACMSERVW for Inspiration range—Up to 16 bottles, https://en.eurocave.com/accessories/443-service-option-light-oak-main-du-sommelier-acmservw-for-inspiration-range-up-to-11-bottles.html.

Miele, KWT 6722 iS, Built-in wine storage unit with FlexiFrame, SommelierSet and Push2open for demanding wine connoisseurs, https://www.mieleusa.com/e/built-in-wine-storage-unit-kwt-6722-is-11329860-p.

Miele, KWT 6312 UGS, Built-under wine storage unit for perfect enjoyment and timeless design with its Push2open and SommelierSet, https://www.mieleusa.com/e/built-under-wine-storage-unit-kwt-6312-ugs-glass-door-10028650-p.

Wine Enthusiast, Wine Enthusiast 24-Bottle Compressor Wine Cooler with Upright Bottle Storage, https://www.wineenthusiast.com/wine-enthusiast-24-bottle-compressor-wine-cooler-with-upright-storage.

Nutrichef, 12 Bottle Thermoelectric Wine Cooler / Chiller, https://www.amazon.com/gp/product/B06XY5CBKW/ref=as_li_tl?ie=UTF8&tag=thoughtcollec-20&camp=1789&creative=9325&linkCode=as2&creativeASIN=B06XY5CBKW&linkId=99efc3923d259f0499e6t6594cf19837.

Marvel, Wine Cooler with Refrigerator Drawers Finish: Black Cabinet With Overlay Frame Glass Door, https://www.amazon.com/dp/B003PC4K3S/?tag=desserecip-20.

Electrolux Home Products, Inc., International Patent Application No. PCT/US2022/017242, International Search Report and Written Opinion, dated Jun. 1, 2022.

* cited by examiner

SHELF SYSTEM FOR A BEVERAGE CABINET

FIELD OF THE INVENTION

The present invention embraces a shelf system for a beverage cabinet.

BACKGROUND

A beverage cabinet (e.g., a cabinet for storing, preserving, conditioning, refrigerating, and/or the like beverages, such as wine, beer, liquor, and/or the like) may include multiple horizontal shelves for holding beverage containers, such as wine bottles, beer bottles, beer cans, liquor bottles, and/or the like. To preserve the quality of the beverage, the beverage containers are typically oriented horizontally on the shelves (e.g., lying down on the shelves). Accordingly, the shelves are typically vertically spaced apart from each other by a distance sufficient to accommodate the widths of the beverage containers (e.g., the heights of wine bottles while oriented horizontally on the shelves and/or the like).

SUMMARY

The following presents a simplified summary of one or more embodiments of the present invention, in order to provide a basic understanding of such embodiments. This summary is not an extensive overview of all contemplated embodiments, and is intended to neither identify key or critical elements of all embodiments nor delineate the scope of any or all embodiments. This summary presents some concepts of one or more embodiments of the present invention in a simplified form as a prelude to the more detailed description that is presented later.

In one aspect, the present invention embraces a cabinet for storage of beverage bottles that includes a door, a housing including a top wall, a bottom wall, a back wall, a left sidewall, a right sidewall, and a front edge, where the door is hingedly attached to the front edge of the housing, and where the top wall, the bottom wall, the back wall, the left sidewall, the right sidewall, and the door form an interior of the housing. In some embodiments, the cabinet may include a bottom shelf suspended above the bottom wall by at least one rail mechanism connected to the bottom shelf and the interior of the housing and a plurality of shelves suspended above the bottom shelf by rail mechanisms connected to the interior of the housing. Additionally, or alternatively, each shelf, of the plurality of shelves, may include a rear support extending approximately from the left sidewall to the right sidewall in a rear portion of the interior, a transverse support extending approximately from the left sidewall to the right sidewall, where the transverse support is offset from the front edge of the housing, and multiple medial supports extending approximately from the front edge of the housing toward the back wall and supported by the rear support and the transverse support. Additionally, or alternatively, at least one shelf, of the shelves, may include at least one medial support that includes a back portion extending from the rear support to the transverse support and a front portion extending from the transverse support toward the front edge of the housing, where the front portion is removable from the back portion and/or the transverse support.

In some embodiments, the front portion connects to the back portion and/or the transverse support via an interference fit.

In some embodiments, for each at least one medial support of each at least one shelf, the front portion may be configured to, after being removed from a first position on the back portion, connect to the back portion of the at least one medial support at a second position. Additionally, or alternatively, for each at least one medial support of each at least one shelf, the front portion may be configured to, after being removed from the first position on the back portion, connect to another back portion of another medial support of another shelf, of the shelves or the bottom shelf, positioned below the shelf from which the front portion was removed. In some embodiments, for each at least one medial support of each at least one shelf, the front portion is configured such that, after the front portion is removed from the first position on the back portion and connected to the back portion of the at least one medial support at the second position and the other back portion of the other medial support of the other shelf, pulling one of the at least one shelf or the other shelf out of the interior of the housing causes the at least one shelf and the other shelf to be pulled out of the interior of the housing.

In some embodiments, the cabinet may include a refrigeration system and a controller for controlling the refrigeration system to maintain one or more target temperatures in the interior of the housing.

In another aspect, the present invention embraces a shelf system for a cabinet that includes a plurality of shelves. In some embodiments, each shelf may include a left lateral support extending approximately from a front of the cabinet to a back of the cabinet and a right lateral support extending approximately from the front of the cabinet to the back of the cabinet. Additionally, or alternatively, each shelf may include a rear support extending approximately from the left lateral support to the right lateral support in a rear portion of the cabinet and a transverse support extending approximately from the left lateral support to the right lateral support, where the transverse support is offset from a front edge of the cabinet. In some embodiments, each shelf may include multiple medial supports extending approximately from the front of the cabinet to the back of the cabinet and supported by the rear support and the transverse support. Additionally, or alternatively, a medial support of the medial supports may include a back portion extending from the rear support to the transverse support and a front portion extending from the transverse support to the front edge of the cabinet, where the front portion is removable from the back portion and/or the transverse support. In some embodiments, shelf system may include multiple left rail mechanisms each securing a left lateral support of the shelves to a left sidewall of the cabinet and multiple right rail mechanisms each securing a right lateral support of the shelves to a right sidewall of the cabinet opposite the left sidewall of the cabinet.

In some embodiments, the shelf system may include a bottom shelf positioned below the shelves in the cabinet.

In some embodiments, the medial support may be a first medial support, and each shelf, of the plurality of shelves, may include a second medial support of the medial supports, where the second medial support includes a back portion extending from the rear support to the transverse support and a front portion extending from the transverse support to the front edge of the cabinet, where the front portion is removable from the back portion and/or the transverse support.

In some embodiments, each medial support, of the medial supports of each shelf of the plurality of shelves may include a back portion extending from the rear support to the transverse support and a front portion extending from the transverse support to the front edge of the cabinet, where the front portion is removable from the back portion and/or the transverse support.

In some embodiments, for each shelf, of the plurality of shelves, the front portion of the medial support may connect to the back portion via an interference fit.

In some embodiments, for each shelf, of the plurality of shelves, the front portion of the medial support may be configured to, after being removed from a first position on the back portion, connect to the back portion of the medial support at a second position. Additionally, or alternatively, for each shelf, of the plurality of shelves, the front portion of the medial support may be configured to, after being removed from the first position on the back portion, connect to another back portion of another medial support of another shelf, of the plurality of shelves, positioned below the shelf from which the front portion was removed.

In yet another aspect, the present invention embraces a shelf system for a cabinet. In some embodiments, the shelf system may include at least one shelf that includes a left lateral support extending approximately from a front of the cabinet to a back of the cabinet and a right lateral support extending approximately from the front of the cabinet to the back of the cabinet. Additionally, or alternatively, the at least one shelf may include a rear support extending approximately from the left lateral support to the right lateral support in a rear portion of the cabinet and a transverse support extending approximately from the left lateral support to the right lateral support, where the transverse support is offset from a front edge of the cabinet. In some embodiments, the at least one shelf may include a plurality of medial supports extending approximately from the front of the cabinet to the back of the cabinet and supported by the rear support and the transverse support. Additionally, or alternatively, a medial support of the medial supports may include a back portion extending from the rear support to the transverse support and a front portion extending from the transverse support to the front edge of the cabinet, where the front portion is removable from the back portion and/or the transverse support.

In some embodiments, the shelf system may include a left rail mechanism securing the left lateral support to a left sidewall of the cabinet and a right rail mechanism securing the right lateral support to a right sidewall of the cabinet opposite the left sidewall of the cabinet. Additionally, or alternatively, the left rail mechanism and the right rail mechanism permit the at least one shelf to move from a storage position within the cabinet to an extended position in which a portion of the at least one shelf extends beyond the front edge of the cabinet.

In some embodiments, the medial support may be a first medial support, and the at least one shelf may include a second medial support of the plurality of medial supports. Additionally, or alternatively, the second medial support may include a back portion extending from the rear support to the transverse support and a front portion extending from the transverse support to the front edge of the cabinet, where the front portion is removable from the back portion and/or the transverse support.

In some embodiments, each medial support, of the plurality of medial supports, may include a back portion extending from the rear support to the transverse support and a front portion extending from the transverse support to the front edge of the cabinet, where the front portion is removable from the back portion and/or the transverse support.

In some embodiments, the front portion of the medial support may connect to the back portion via an interference fit.

In some embodiments, the front portion of the medial support may be configured to, after being removed from a first position on the back portion, connect to the back portion of the medial support at a second position. Additionally, or alternatively, the front portion of the medial support may be configured to, after being removed from the first position on the back portion, connect to another back portion of another medial support of another shelf positioned below the shelf from which the front portion was removed.

In some embodiments, the shelf system may include multiple shelves, where each shelf, of the multiple shelves, may include at least one medial support including a removable front portion toward the front edge of the cabinet.

In some embodiments, the at least one shelf may include a front support extending from the left lateral support to the right lateral support and the front support may support the medial supports. Additionally, or alternatively, the front portion, of the medial support, may extend from the transverse support to the front support, and the front portion, of the medial support, may be removable from the front support.

The features, functions, and advantages that have been discussed may be achieved independently in various embodiments of the present invention or may be combined with yet other embodiments, further details of which may be seen with reference to the following description and drawings.

BRIEF DESCRIPTION OF THE DRAWINGS

Figure 1:
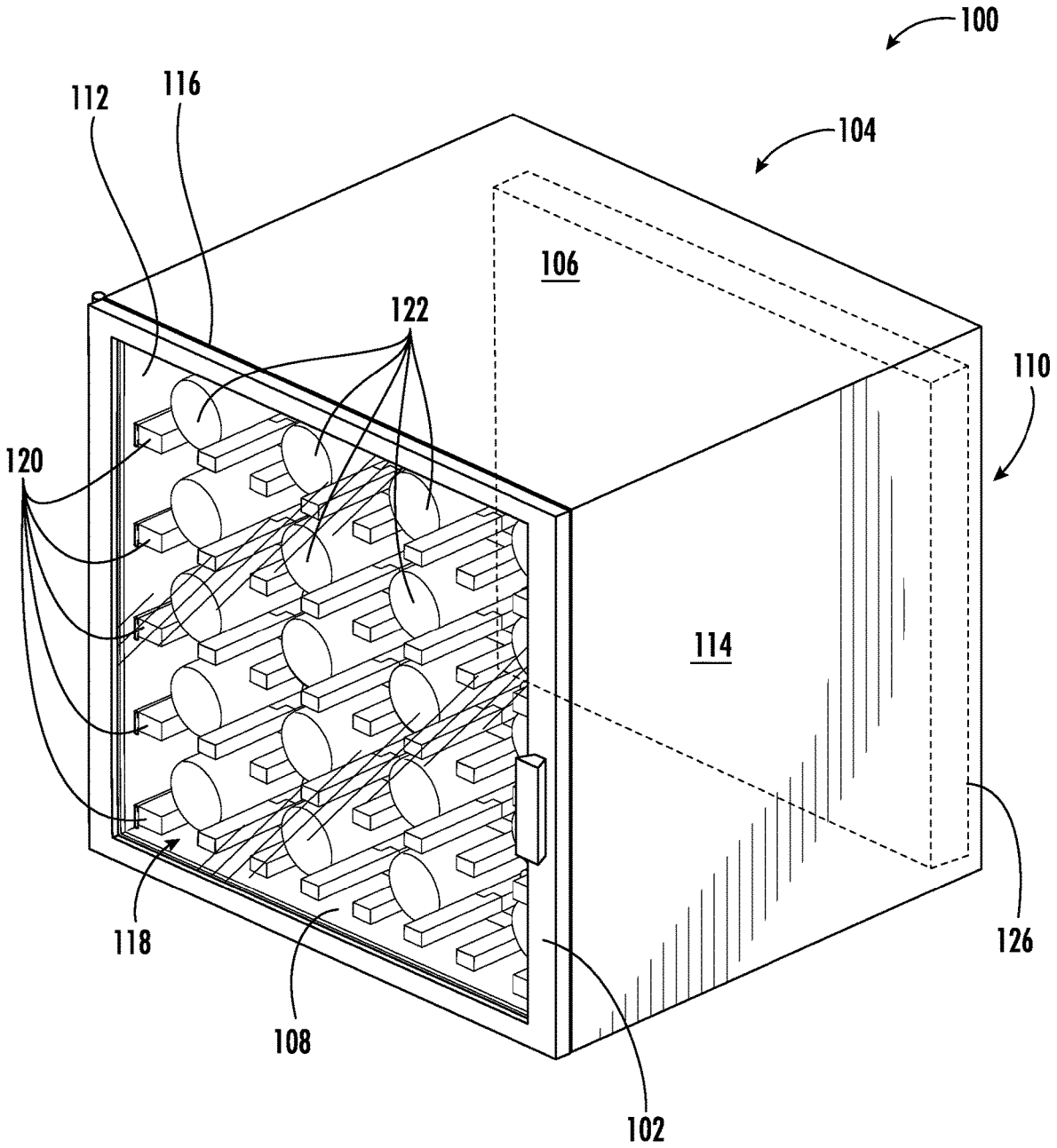
Figure 2:
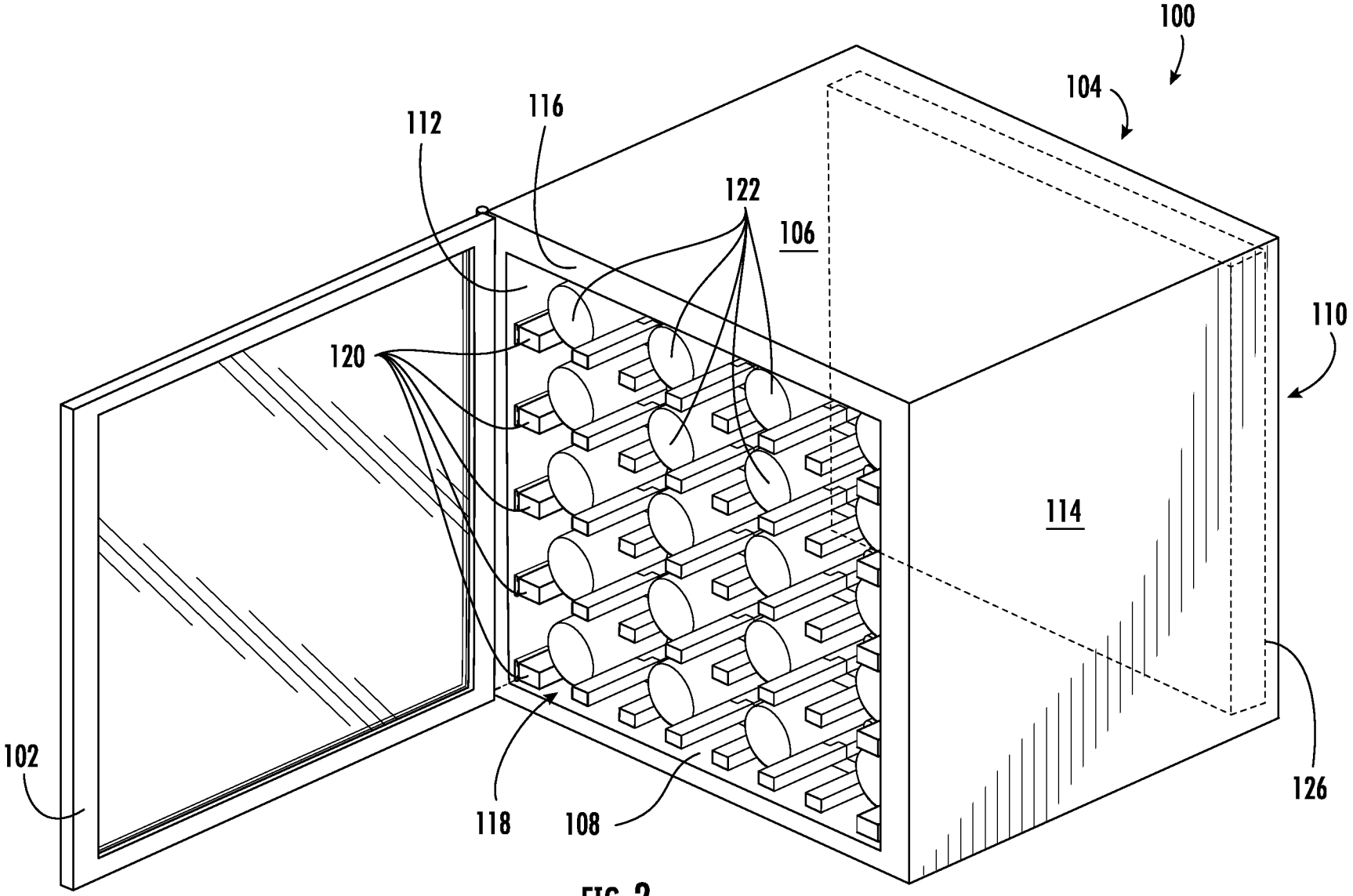
Figure 3:
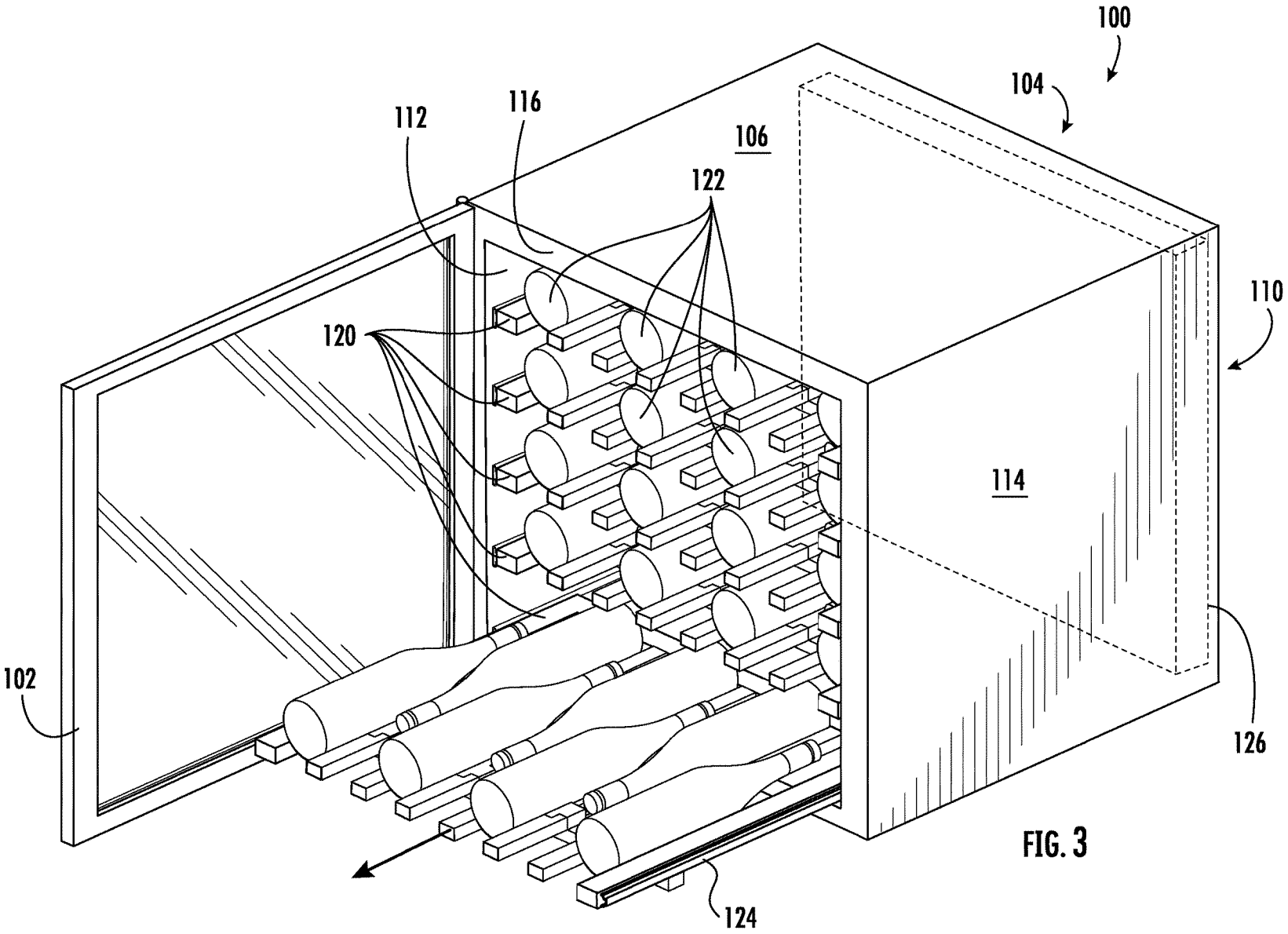
Figure 4:
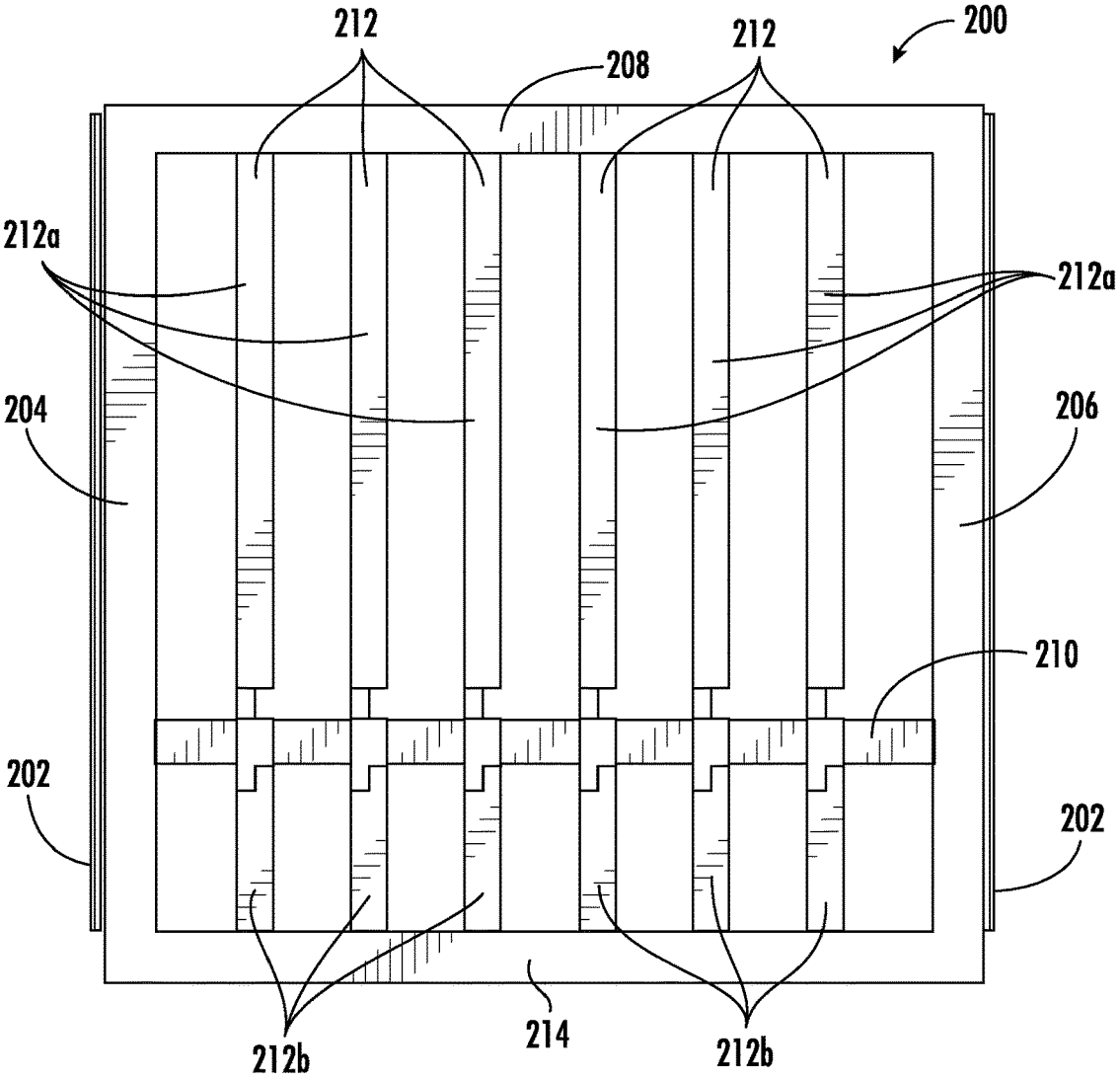
Figure 5:
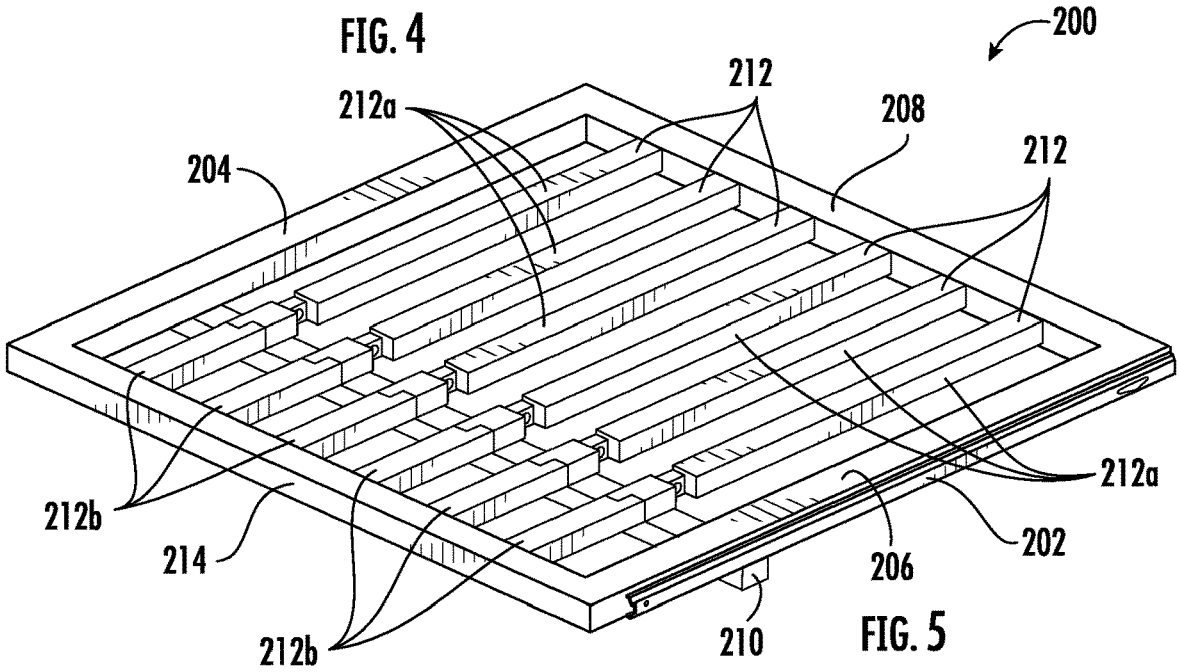
Figure 6:
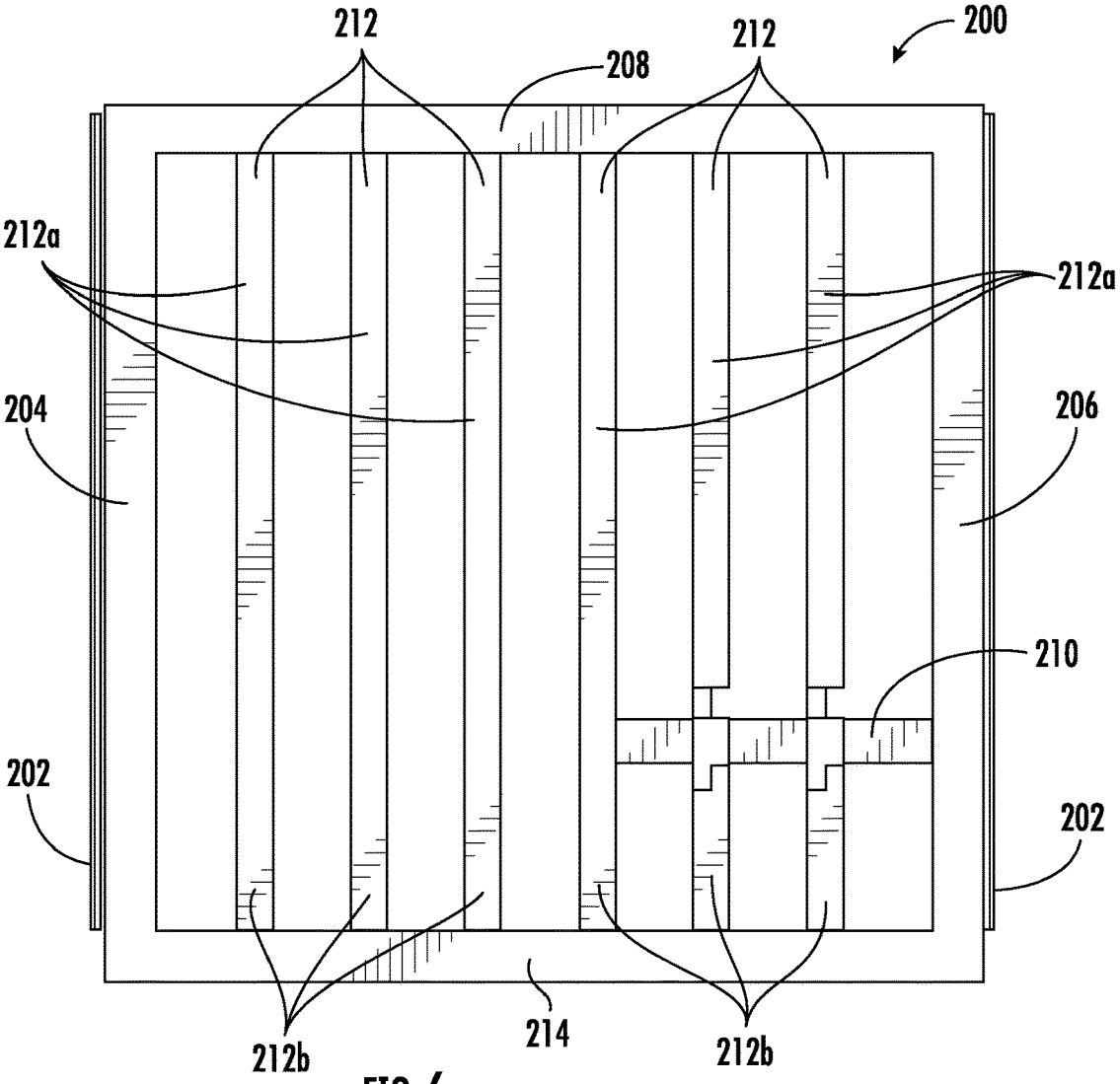
Figure 7:
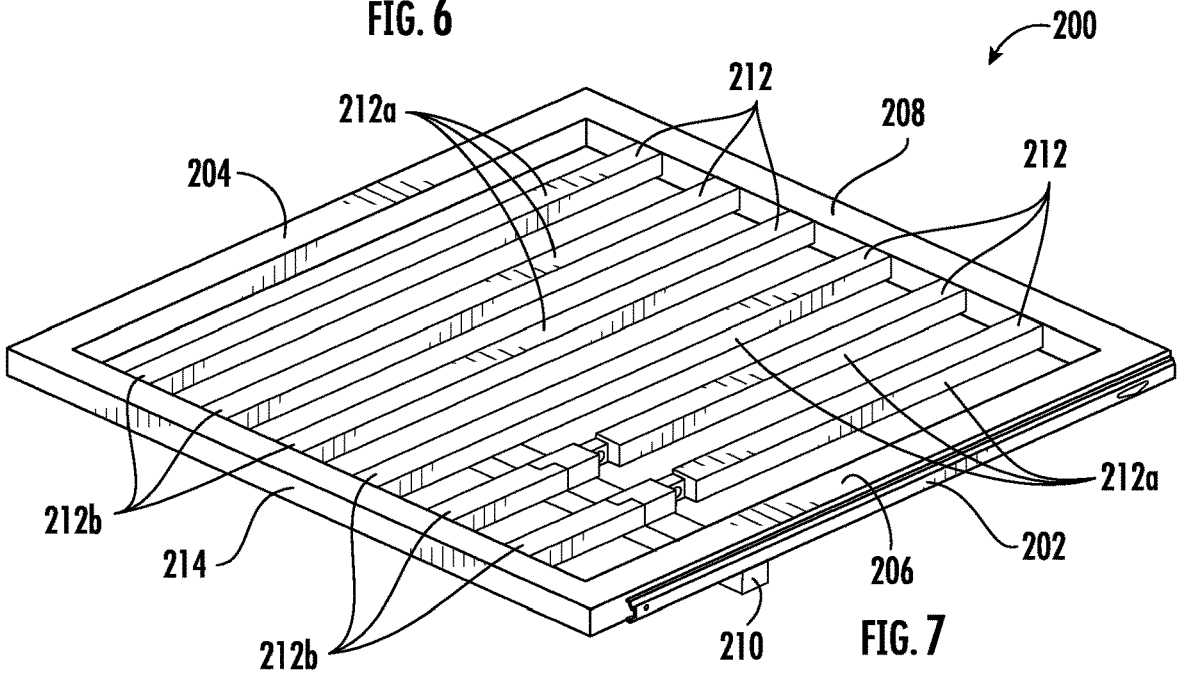
Figure 8:
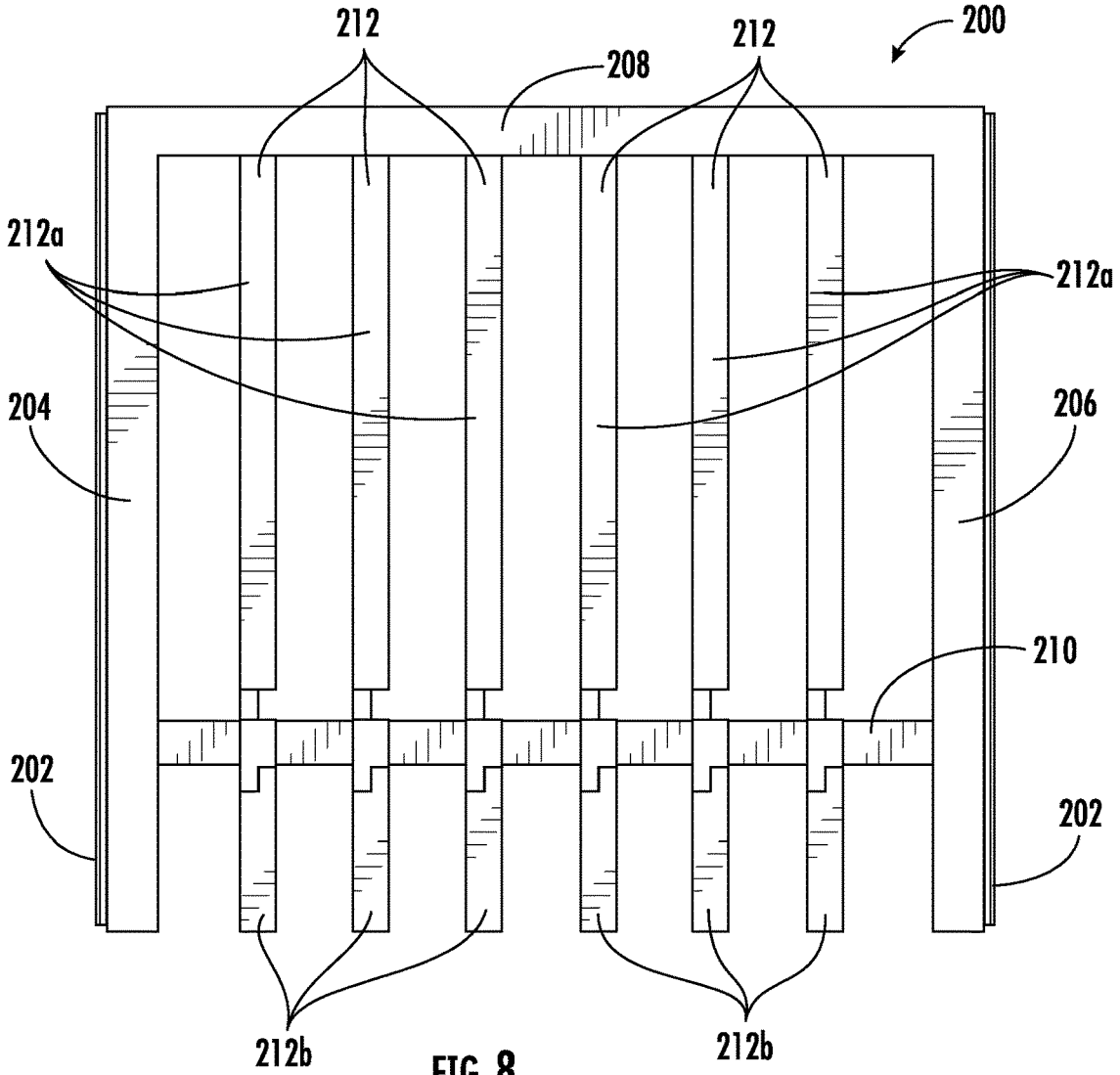
Figure 9:
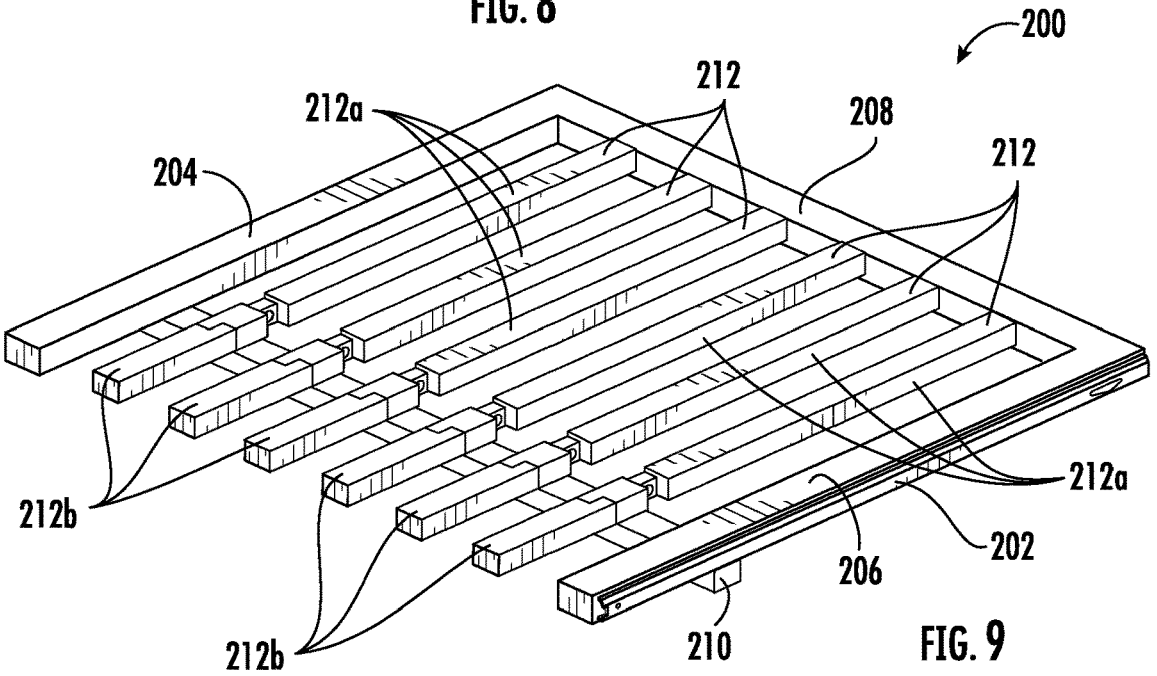
Figure 10:
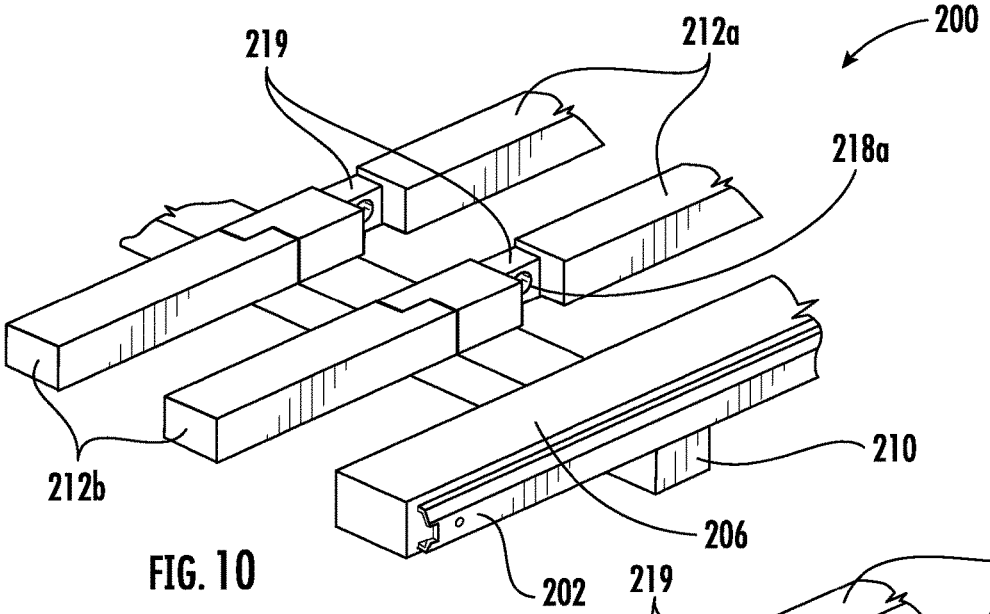
Figure 11:
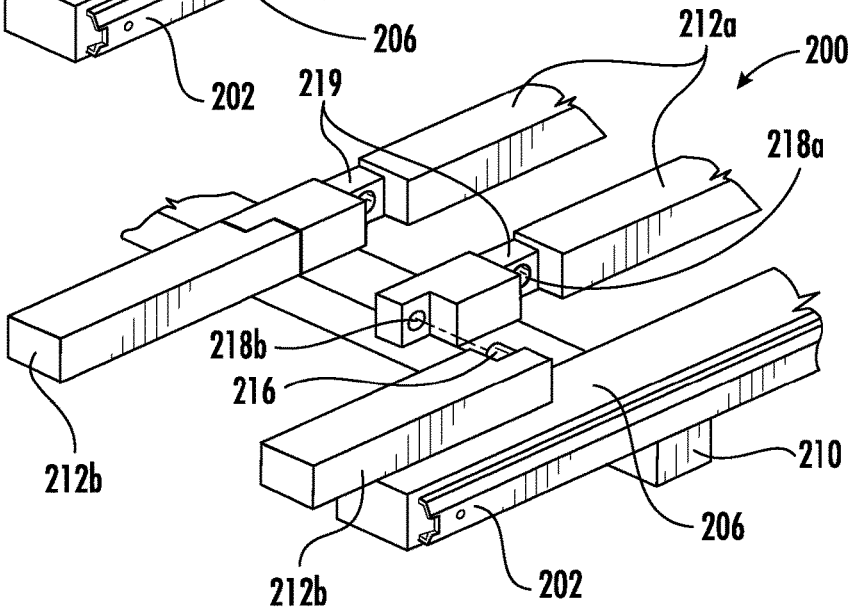
Figure 12:
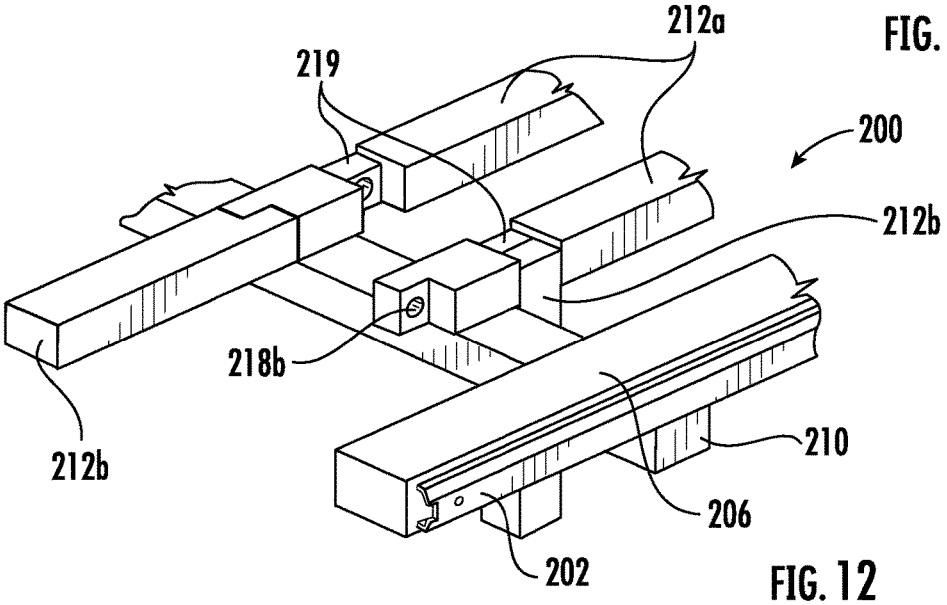
Figure 13:
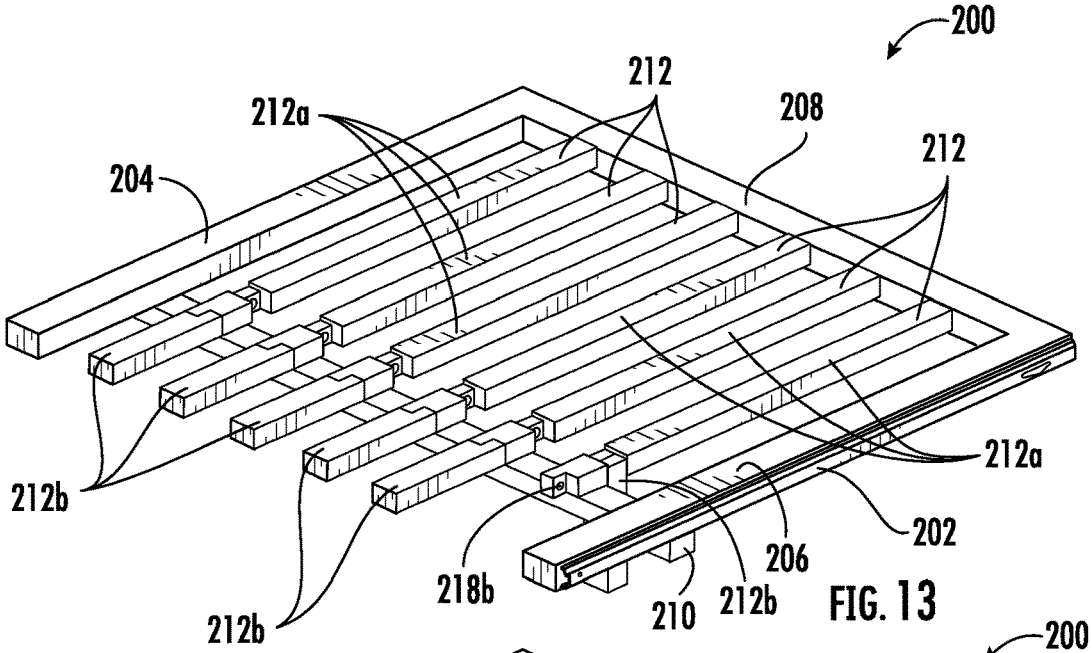
Figure 14:
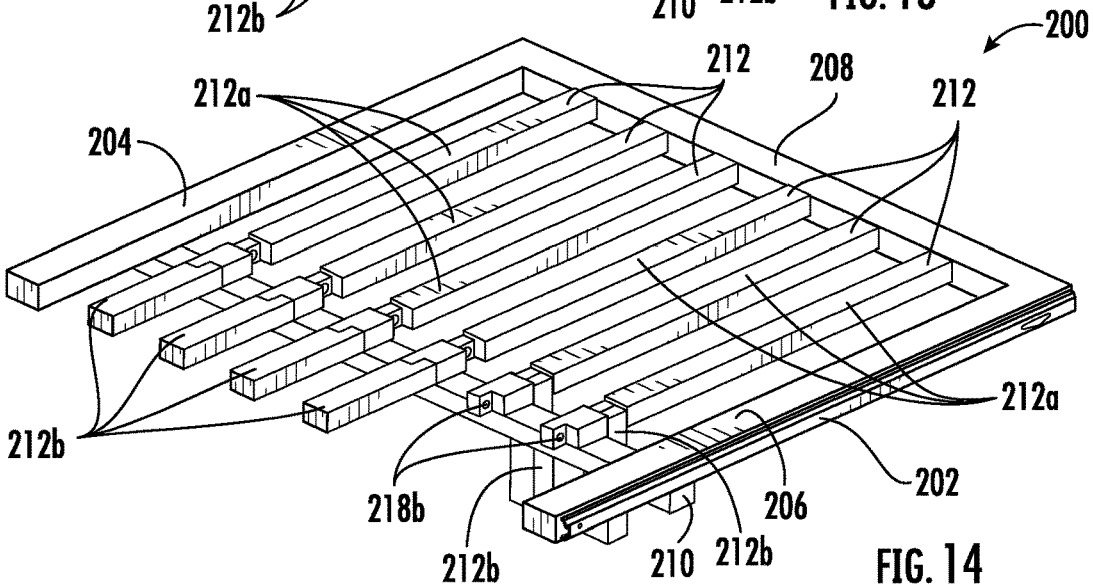
Figure 15:
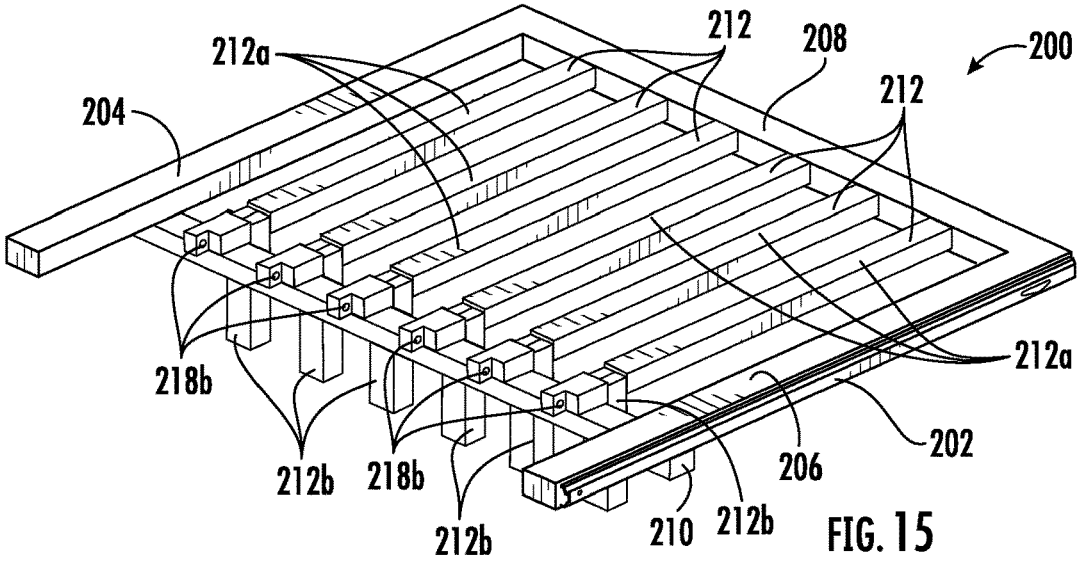
Figure 16:
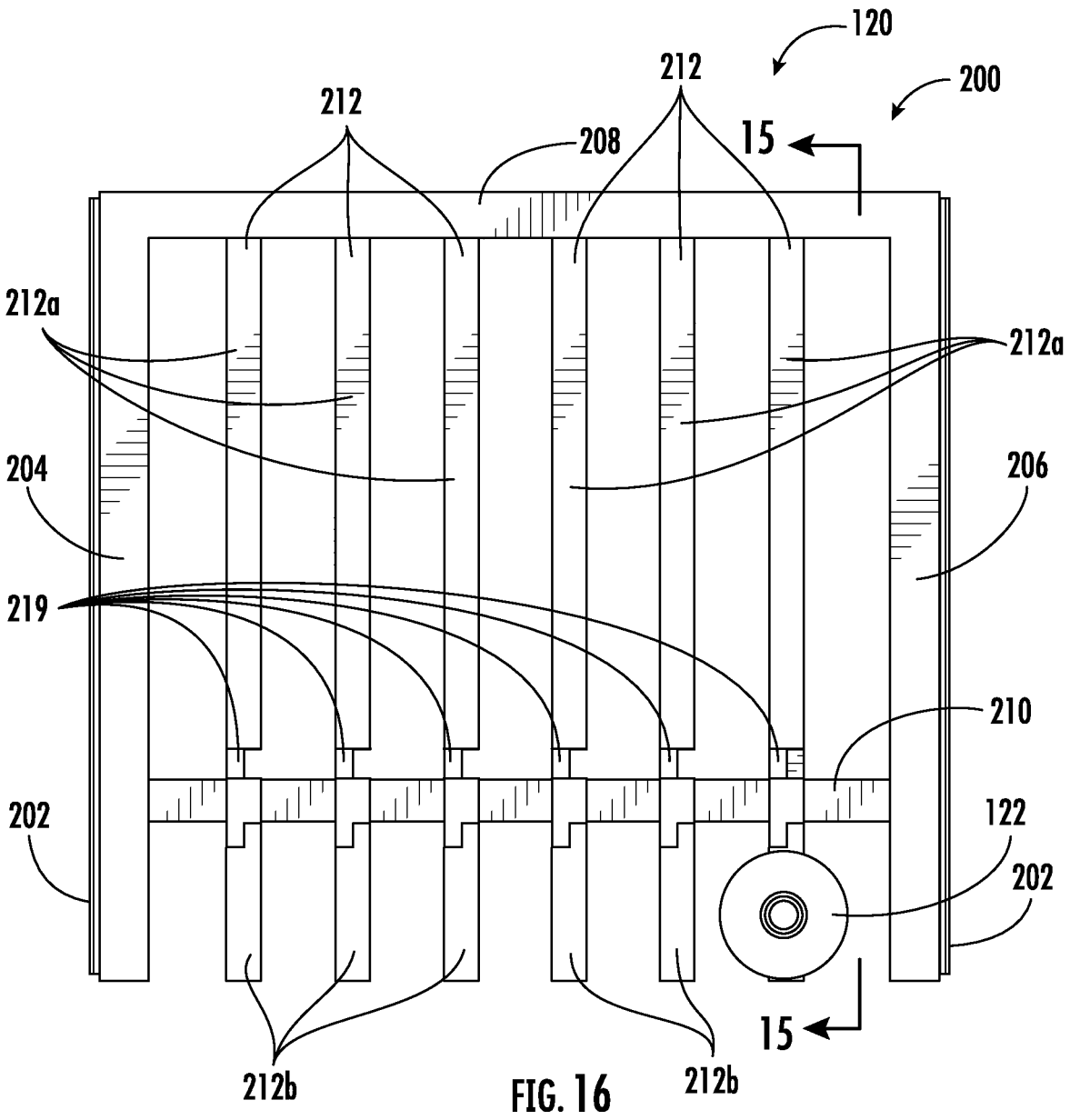
Figure 17:
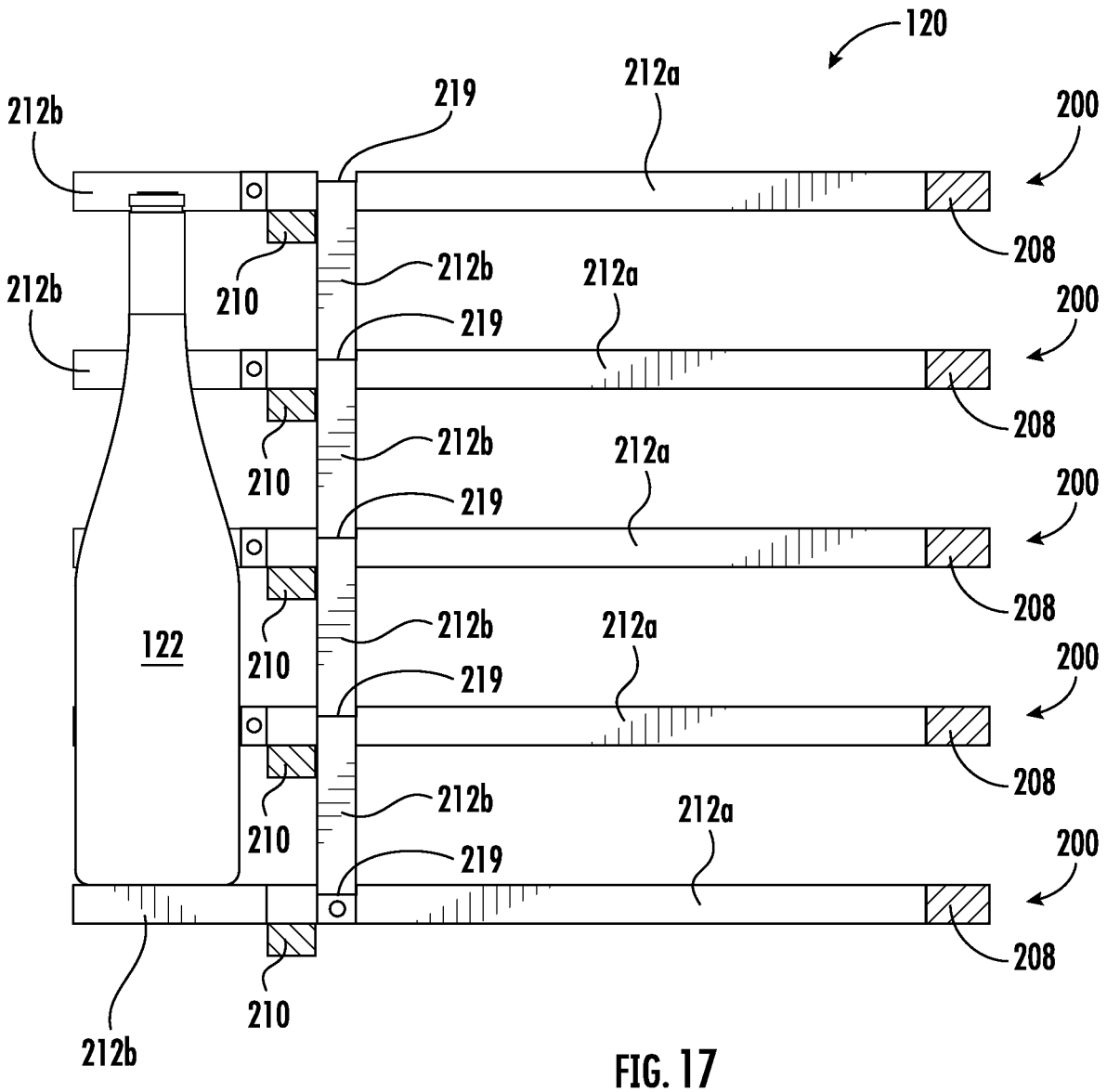
Figure 18:
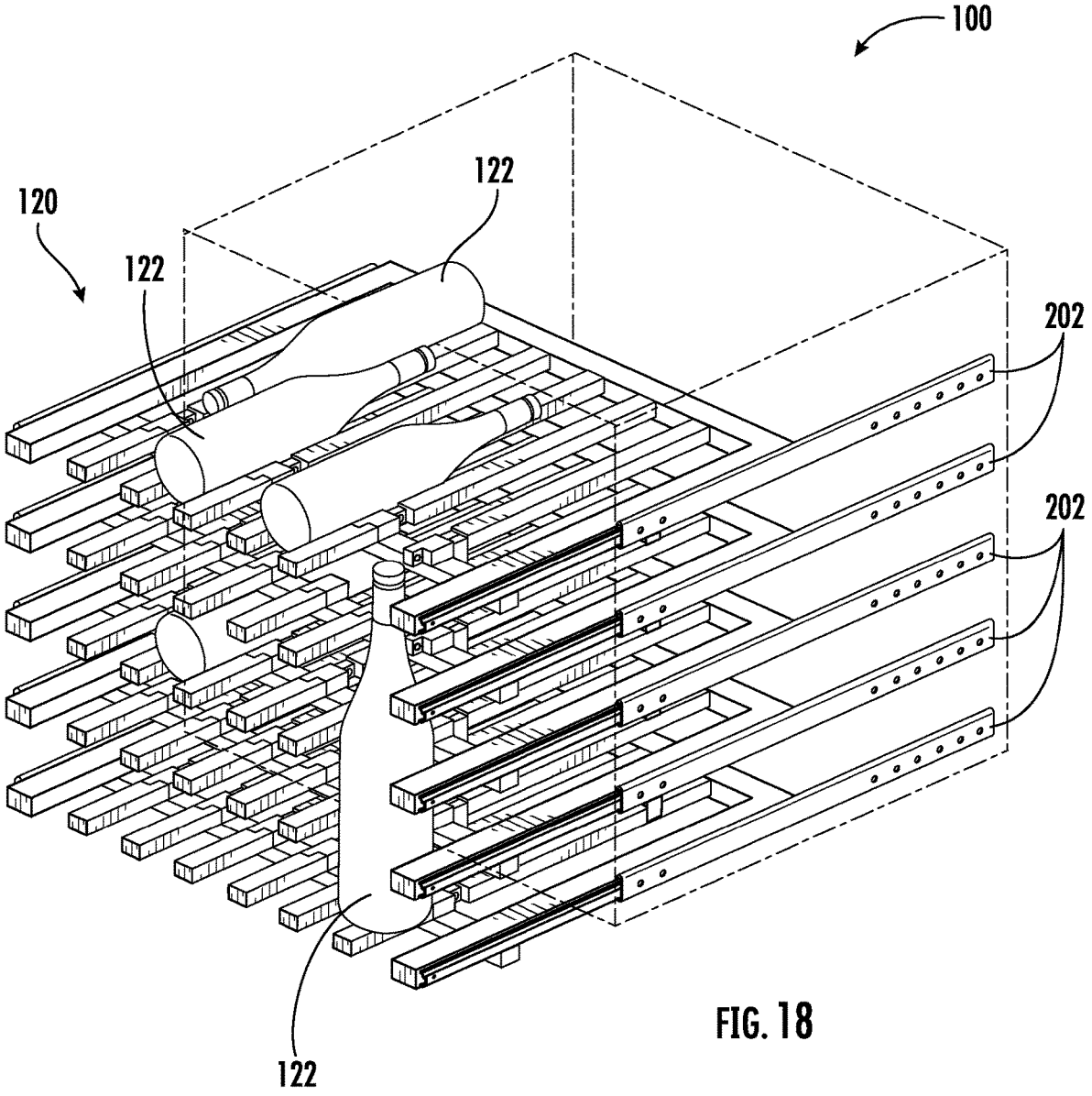
Figure 19:
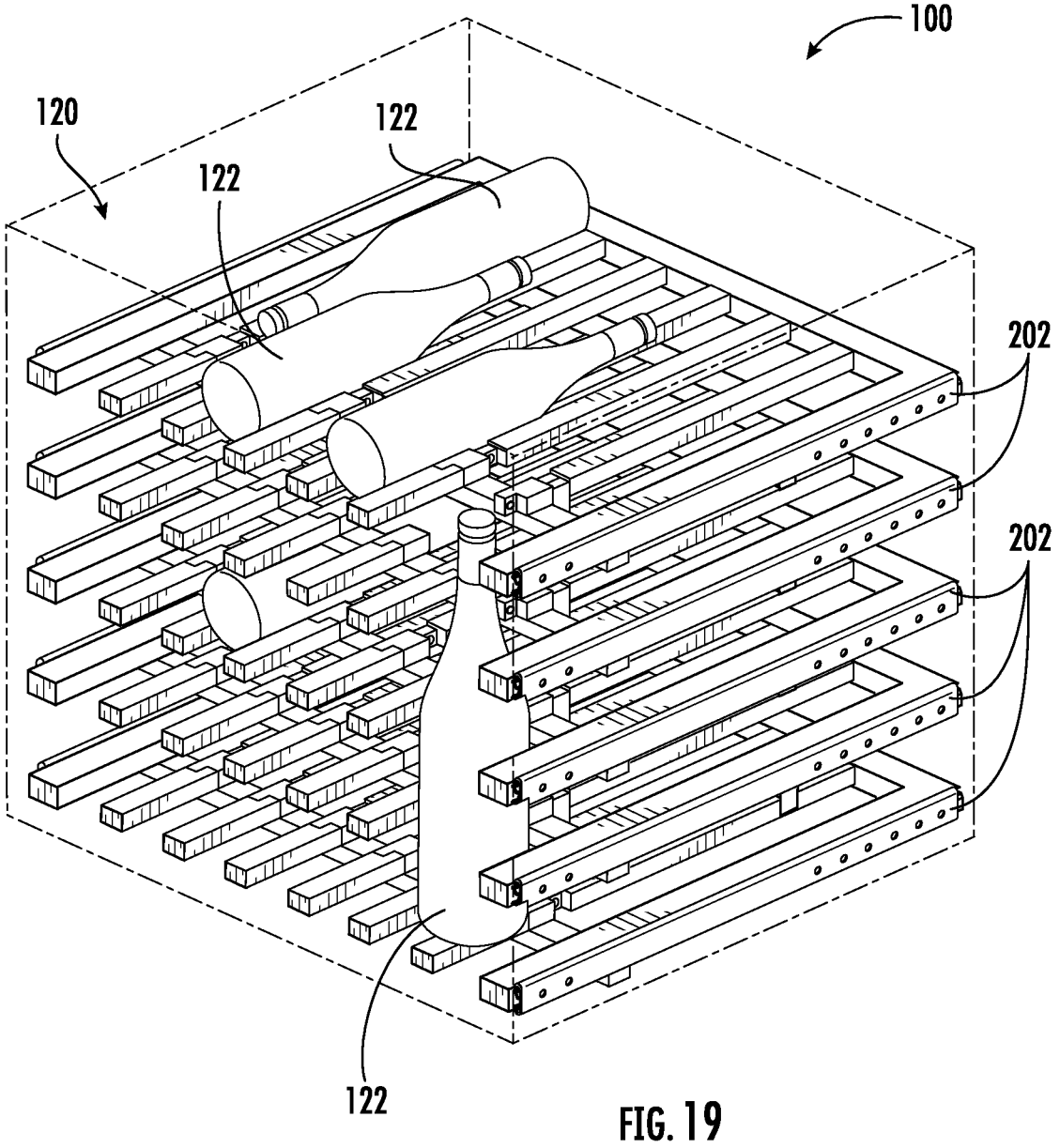

Having thus described embodiments of the invention in general terms, reference will now be made the accompanying drawings, wherein:

FIG. 1 illustrates a cabinet having a shelf system and beverage bottles stored therein with a door in a closed position, in accordance with an embodiment of the invention;

FIG. 2 illustrates a cabinet having a shelf system and beverage bottles stored therein with a door in an open position, in accordance with an embodiment of the invention;

FIG. 3 illustrates a cabinet having a shelf system and beverage bottles stored therein with a shelf in an extended position, in accordance with an embodiment of the invention;

FIG. 4 illustrates a top view of a shelf of a shelf system, in accordance with an embodiment of the invention;

FIG. 5 illustrates a perspective view of a shelf of a shelf system, in accordance with an embodiment of the invention;

FIG. 6 illustrates a top view of a shelf of a shelf system, in accordance with an embodiment of the invention;

FIG. 7 illustrates a perspective view of a shelf of a shelf system, in accordance with an embodiment of the invention;

FIG. 8 illustrates a top view of a shelf of a shelf system, in accordance with an embodiment of the invention;

FIG. 9 illustrates a perspective view of a shelf of a shelf system, in accordance with an embodiment of the invention;

FIG. 10 illustrates a close-up, perspective view of a portion of a shelf of a shelf system, in accordance with an embodiment of the invention;

FIG. 11 illustrates a close-up, perspective view of a portion of a shelf of a shelf system, in accordance with an embodiment of the invention;

FIG. 12 illustrates a close-up, perspective view of a portion of a shelf of a shelf system, in accordance with an embodiment of the invention;

FIG. 13 illustrates a perspective view of a shelf of a shelf system, in accordance with an embodiment of the invention;

FIG. 14 illustrates a perspective view of a shelf of a shelf system, in accordance with an embodiment of the invention;

FIG. 15 illustrates a perspective view of a shelf of a shelf system, in accordance with an embodiment of the invention;

FIG. 16 illustrates a top view of a shelf system having a beverage bottle stored therein in an upright orientation, in accordance with an embodiment of the invention;

FIG. 17 illustrates a side view of the shelf system of FIG. 16 having a beverage bottle stored therein in an upright orientation, in accordance with an embodiment of the invention;

FIG. 18 illustrates a perspective view of the shelf system of FIG. 16 having a beverage bottle stored therein in an upright orientation and having shelves in an extended position, in accordance with an embodiment of the invention; and FIG. 19 illustrates a perspective view of the shelf system of FIG. 16 having a beverage bottle stored therein in an upright orientation and having shelves in a stored position, in accordance with an embodiment of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

As noted, a beverage cabinet (e.g., a cabinet for storing, preserving, conditioning, refrigerating, and/or the like beverages, such as wine, beer, liquor, and/or the like) may include multiple horizontal shelves for holding beverage containers, such as wine bottles, beer bottles, beer cans, liquor bottles, and/or the like. To preserve the quality of the beverage, the beverage containers are typically oriented horizontally on the shelves (e.g., lying down on the shelves). Accordingly, the shelves are typically vertically spaced apart from each other by a distance sufficient to accommodate the widths of the beverage containers (e.g., the heights of wine bottles while oriented horizontally on the shelves and/or the like). To efficiently use the space within the beverage cabinet, the vertical spacing between the shelves is typically slightly greater than the widths of the beverage containers and much less than the vertical height of the beverage containers. However, after opening one of the beverage containers, the contents of the beverage container may not be completely consumed, but the beverage container cannot be stored upright (e.g., oriented vertically) in the beverage cabinet due to the vertical spacing between the shelves. Furthermore, if the opened beverage container were to be oriented horizontally in the beverage cabinet, the contents of the beverage container may spill, leak, and/or the like into the beverage cabinet.

Some embodiments described herein provide a shelf system for a beverage cabinet that may be transformed to accommodate storage of one or more beverage containers in an upright orientation. For example, a beverage cabinet may include one or more shelves for supporting beverage containers oriented horizontally on the shelves, and the shelves may include rear supports (e.g., rear support slats) extending approximately across a width of the beverage cabinet in a rear portion of the beverage cabinet, transverse supports (e.g., transverse support slats) extending approximately across the width of the beverage cabinet in a front portion of the beverage cabinet, and medial supports (e.g., medial slats) extending approximately from the front portion of the beverage cabinet to the rear portion of the beverage cabinet and supported by the rear supports and the transverse supports. In some embodiments, at least one of the shelves may include a transverse support offset from the front edge of the beverage cabinet and one or more medial supports including a front portion and a back portion, where the front portion is removable from the back portion. Additionally, or alternatively, the front portion of the medial support may extend approximately from the transverse support to the front edge of the beverage cabinet and may be removable from the transverse support. In this way, a front portion of a medial support of a shelf may be removed, and a beverage container may be placed on another shelf below the shelf in an upright orientation and may extend through the shelf from which the front portion of the medial support was removed. By offsetting the transverse support from the front edge of the beverage cabinet, the shelf may accommodate the upright orientation of the beverage container while supporting other beverage containers oriented horizontally on the shelf.

FIGS. 1-3 illustrate a cabinet 100 (e.g., a beverage cabinet and/or the like) having a shelf system 120 and beverage bottles 122 stored therein. As shown in FIGS. 1-3, the cabinet 100 may include a door 102 and a housing 104, which may include a top wall 106, a bottom wall 108, a back wall 110, a left sidewall 112, a right sidewall 114, and a front edge 116. In some embodiments, and as shown in FIGS. 1-3, the door 102 may be hingedly attached to the front edge 116 of the cabinet 100, and may be moved (e.g., by a user) from a closed position as shown in FIG. 1 to an open position as shown in FIGS. 2 and 3.

As shown in FIGS. 1-3, the top wall 106, the bottom wall 108, the back wall 110, the left sidewall 112, the right sidewall 114, and the door 102 may form an interior 118 of the housing 104 of the cabinet 100. Additionally, the cabinet 100 may include a shelf system 120 within the interior 118 of the housing 104 for supporting one or more bottles 122. For example, and as shown in FIGS. 1-3, the shelf system 120 may be configured to support the bottles 122 while the bottles 122 are oriented horizontally (e.g., lying down on shelves of the shelf system 120). To efficiently use the space within the interior 118 of the housing 104, the vertical spacing between the shelves of the shelf system 120 may be slightly greater than the widths of the bottles 122 and less than the vertical height of the bottles 122.

As shown in FIGS. 1-3, the cabinet 100 may include a refrigeration system and a controller 126, which may be positioned in a rear portion of the housing 104. In some embodiments, the controller may control the refrigeration system to maintain one or more target environmental conditions (e.g., temperatures, humidity levels, and/or the like) in the interior 118 of the housing 104. For example, the cabinet 100 may include one or more environmental sensors (e.g., temperature sensors, humidity sensors, and/or the like) positioned within the interior 118 of the housing 104 and configured to generate one or more signals based on a sensed environment condition, and the controller may be configured to control the refrigeration system based on the one or more signals from the one or more environmental sensors to maintain one or more target environmental conditions.

As shown in FIG. 3, the cabinet 100 may include a rail mechanism 124 configured to support a shelf within the interior 118 of the housing 104. For example, each shelf of the shelf of the shelf system 120 may include a rail mechanism 124 on the left and right sides of the shelf, where the rail mechanism secures the shelf to an interior surface of a sidewall (e.g., the left sidewall 112, the right sidewall 114, and/or the like) of the housing 104. As shown in FIG. 3, the rail mechanism 124 may permit the shelf to move from a storage position within the interior 118 of the housing 104 to an extended position in which a portion of the shelf extends beyond the front edge 116 (e.g., to provide access to the bottles 122 and/or the like). For example, the rail mechanism 124 may include a telescopic rail mechanism and/or the like. Although FIG. 3 only depicts one rail mechanism 124 on a bottom shelf of the shelf system 120, the cabinet 100 may include additional rail mechanisms on the left and right sides of other shelves (e.g., each shelf and/or the like) of the shelf system 120.

FIGS. 4 and 5 illustrate a shelf 200 of a shelf system (e.g., the shelf system 120 of FIGS. 1-3), in accordance with an embodiment of the invention. As shown in FIGS. 4 and 5, the shelf 200 may include rail mechanisms 202, a left lateral support 204 (e.g., a left lateral slat), a right lateral support 206 (e.g., a right lateral slat), a rear support 208 (e.g., a rear support slat), a transverse support 210 (e.g., a transverse support slat), medial supports 212 (e.g., medial slats), and a front support 214 (e.g., a front support slat). In some embodiments, the left lateral support 204, the right lateral support 206, the rear support 208, the transverse support 210, and/or the front support 214 may provide a frame for supporting the medial supports 212.

As shown in FIGS. 4 and 5, the shelf 200 may include two rail mechanisms 202 on either side of the shelf 200. In some embodiments, the rail mechanisms 202 may be similar to the rail mechanism 124 described herein with respect to FIGS. 1-3. For example, the rail mechanisms 202 may secure the shelf 200 to interior surfaces of sidewalls of a cabinet, permit the shelf 200 to move from a storage position to an extended position, and/or may include a telescopic rail mechanism and/or the like. Additionally, or alternatively, one of the rail mechanisms 202 may be attached, connect to, and/or the like the left lateral support 204, and another of the rail mechanisms 202 may be attached, connect to, and/or the like the right lateral support 206.

As shown in FIGS. 4 and 5, the shelf 200 may include a plurality of medial supports 212 extending from the front support 214 to the rear support 208. For example, when the shelf 200 is positioned within a cabinet (e.g., cabinet 100 of FIGS. 1-3), the medial supports 212 may extend from a front of the cabinet to a back of the cabinet and may be supported by the rear support 208, the transverse support 210, and/or the front support 214. Although the embodiment of the shelf 200 depicted in FIGS. 4 and 5 includes six medial supports 212, other embodiments of the shelf 200 may include fewer medial supports 212 (e.g., one, two, three, four, or five) or more medial supports 212 (e.g., seven, eight, nine, ten, or more).

As shown in FIGS. 4 and 5, the medial supports 212 may include back portions 212*a* and front portions 212*b*. The back portions 212*a* may extend from the rear support 208 to the transverse support 210, and the front portions 212*b* may extend from the transverse support 210 to the front support 214. In some embodiments, and as described further herein with respect to FIGS. 10-15, the front portions 212*b* may be removable from and may connect to the back portions 212*a* via an interference fit, such as correspondingly shaped cutouts, a peg-and-hole mechanism, and/or the like. Additionally, or alternatively, the front portions 212*b* may be removable from and may connect to the transverse support 210 and/or the front support 214 via an interference fit.

Although the embodiment of the shelf 200 depicted in FIGS. 4 and 5 includes medial supports 212 that each include a front portion 212*b* removable from and connected to a back portion 212*a*, other embodiments of the shelf 200 may include medial supports 212 that do not include a front portion 212*b* removable from and connected to a back portion 212*a* (e.g., medial supports 212 formed of a single portion of material, such as wood, metal, and/or the like). As another example, other embodiments of the shelf 200 may include some medial supports 212 (e.g., two, three, four, five, six, or more) including a front portion 212*b* removable from and connected to a back portion 212*a*, and other medial supports 212 (e.g., one, two, three, four, five, six, or more) that do not include a front portion 212*b* removable from and connected to a back portion 212*a*. As yet another example, other embodiments of the shelf 200 may include a single medial support 212 including a front portion 212*b* removable from and connected to a back portion 212*a*, and other medial supports 212 that do not include a front portion 212*b* removable from and connected to a back portion 212*a*.

FIGS. 6 and 7 illustrate a shelf 200 of a shelf system (e.g., the shelf system 120 of FIGS. 1-3), in accordance with another embodiment of the invention. As shown in FIGS. 6 and 7, the shelf 200 may include rail mechanisms 202, a left lateral support 204 (e.g., a left lateral slat), a right lateral support 206 (e.g., a right lateral slat), a rear support 208 (e.g., a rear support slat), a transverse support 210 (e.g., a transverse support slat), medial supports 212 (e.g., medial slats), and a front support 214 (e.g., a front support slat). In some embodiments, the left lateral support 204, the right lateral support 206, the rear support 208, and/or the front support 214 may provide a frame for supporting the medial supports 212. In some embodiments, the shelf 200, the rail mechanisms 202, the left lateral support 204, the right lateral support 206, the rear support 208, and the front support 214 of the embodiment of FIGS. 6 and 7 may be similar to the shelf 200, the rail mechanisms 202, the left lateral support 204, the right lateral support 206, the rear support 208, and the front support 214 of the embodiment of FIGS. 4 and 5. In this regard, the shelf 200 of FIGS. 6 and 7 includes some medial supports 212 for which the front portions 212*b* are unitary (e.g., not removable from, formed of a single portion of material, and/or the like) with the back portions 212*a* and some medial supports 212 for which the front portions 212*b* may be removable from and may connect to the back portions 212*a* as described further herein with respect to FIGS. 10-15.

For example, and as shown in FIGS. 6 and 7, the two rightmost medial supports 212 may include front portions 212*b* that are removable from and connect to the back portions 212*a*, and the other medial supports 212 may be unitary. In such an example, and as also shown in FIGS. 6 and 7, the transverse support 210 may extend from a rightmost unity medial support 212 to the right lateral support 206. By extending across a shorter portion of the shelf 200, the transverse support 210 may increase an amount of storage space between shelves, while also permitting storage of bottles in an upright orientation.

Although the embodiment of the shelf 200 depicted in FIGS. 6 and 7 includes two medial supports 212 including front portions 212*b* that are removable from and connected to the back portions 212*a*, additional medial supports 212 (e.g., the three rightmost, the four rightmost, and/or the like) may include front portions 212*b* that are removable from and connected to the back portions 212*a*. Furthermore, although the embodiment of the shelf 200 depicted in FIGS. 6 and 7 includes rightmost medial supports 212 including front portions 212*b* that are removable from and connected to the back portions 212*a*, medial supports 212 in other positions (e.g., the leftmost, the central, and/or the like) may include front portions 212*b* that are removable from and connected to the back portions 212*a*.

FIGS. 8 and 9 illustrate a shelf 200 of a shelf system (e.g., the shelf system 120 of FIGS. 1-3), in accordance with another embodiment of the invention. As shown in FIGS. 8 and 9, the shelf 200 may include rail mechanisms 202, a left lateral support 204, a right lateral support 206, a rear support 208, a transverse support 210, and medial supports 212. In some embodiments, the shelf 200, the rail mechanisms 202, the left lateral support 204, the right lateral support 206, the rear support 208, the transverse support 210, and the medial supports 212 of the embodiment of FIGS. 8 and 9 may be similar to the shelf 200, the rail mechanisms 202, the left lateral support 204, the right lateral support 206, the rear support 208, the transverse support 210, and the medial supports 212 of the embodiment of FIGS. 4 and 5. In this regard, the shelf 200 of FIGS. 8 and 9 does not include a front support 214 as shown in the shelf 200 of FIGS. 4 and 5.

FIGS. 10-12 illustrate close-up, perspective views of a portion of the shelf 200 of FIGS. 8 and 9, in accordance with an embodiment of the invention. Furthermore, FIGS. 10-12 illustrate an exemplary embodiment of an interference fit by which the front portions of medial supports may be removable from and may connect to the back portions of medial supports. Accordingly, it is within the scope of the present invention to use other interference fits and/or removable connections to removably connect front portions of medial supports to back portions of medial supports.

In some embodiments, and as shown in FIG. 10, the back portion 212*a* of a medial support (e.g., the medial support adjacent the right lateral support 206 and/or the like) may include a cutout portion and a hole 218*a* adjacent and behind the transverse support 210. Additionally, or alternatively, and as shown in FIGS. 11 and 12, the back portion 212*a* of the medial support may include a cutout portion and a hole 218*b* adjacent and in front of the transverse support 210. As shown in FIG. 11, the front portion 212*b* of the medial support may include a cutout and a peg 216 corresponding to the cutout portion and the hole 218*a* and the cutout portion and the hole 218*b*. As also shown in FIG. 11, the front portion 212*b* of the medial support may be removed from the back portion 212*a* of the medial support. As shown in FIG. 12, the front portion 212*b* of the medial support may, after being removed from the back portion 212*a*, be reconnected to a different portion of the back portion 212*a* via the cutout portion and the hole 218*a*. Stated differently, the front portion 212*b* may be removably connected, in front of the transverse support 210, to the back portion 212*a*, and the front portion 212*b* may also be removably connected, behind the transverse support 210, to the back portion 212*a*.

In some embodiments, and as described further herein with respect to FIGS. 16-19, the front portion 212*b* of a medial support 212 may be removed to accommodate a beverage bottle stored in an upright orientation (e.g., a beverage bottle that is open but the contents of which may not be completely consumed and/or the like). For example, the front portion 212*b* of the medial support 212 of the shelf 200 may be removed, and a beverage bottle may be placed on another shelf below the shelf 200 in an upright orientation and may extend through the shelf 200 from which the front portion 212*b* was removed.

As further described herein with respect to FIGS. 16-19, the front portion 212*b* may be configured to, after being removed from the back portion 212*a*, connect to the back portion 212*a* of the medial support from which it was removed, and another back portion 212*a* of another medial support of another shelf positioned above or below the shelf from which the front portion was removed. In some embodiments, and as shown in FIG. 12, after being reconnected to the back portion 212*a* in a position behind the transverse support 210, the front portion 212*b* may extend downwardly, which may cause the front portion 212*b* to interact with another shelf positioned below the shelf 200 (e.g., to connect to the other shelf, to interact with a transverse support of the shelf, and/or the like). Accordingly, in some embodiments, the front portion 212*b* may have a length configured such that, after being removed from the back portion 212*a* and then reconnected to a position behind the transverse support 210, the front portion 212*b* interacts with another shelf positioned above or below the shelf. In this regard, the back portion 212*a* of the medial supports may include a channel 219 adjacent to the cutout portion and hole 218*b*. An end the front portion 212*b* may be configured to fit into and engage a channel 219 of the immediately below shelf.

FIGS. 13-15 illustrate perspective views of the shelf 200 of FIGS. 8-12, in accordance with an embodiment of the invention. As shown in FIG. 13, the front portion 212*b* of the right-most medial support 212 has been removed from the cutout portion and the hole 218*b*, of the back portion 212*a*, adjacent and in front of the transverse support 210, and has been reconnected to the back portion 212*a* via a cutout portion and a hole adjacent and behind the transverse support 210. By removing and reconnecting the front portion 212*b* in this manner, a beverage bottle may be placed on another shelf below the shelf 200 in an upright orientation and may extend through the shelf 200.

In some embodiments, and as shown in FIG. 14, the front portions 212*b* of the two right-most medial supports 212 may be removed and reconnected to the back portions 212*a* behind the transverse support 210. By removing and reconnecting the front portions 212*b* of two medial supports 212, additional space may be created in the shelf 200 to accommodate storage of one or more beverage bottles placed on another shelf below the shelf 200 in upright orientations and such that the one or more beverage bottles may extend through the shelf 200.

Additionally, or alternatively, and as shown in FIG. 15, the front portions 212*b* of the each of the medial supports 212 may be removed and reconnected to the back portions 212*a* behind the transverse support 210. By removing and reconnecting the front portions 212*b* of each of the medial supports 212, additional space may be created in the shelf 200 to accommodate storage of multiple beverage bottles placed on another shelf below the shelf 200 in upright orientations and such that the beverage bottles may extend through the shelf 200.

FIG. 16 illustrates a top view of the shelf system 120 having a bottle 122 stored therein in an upright orientation, in accordance with an embodiment of the invention. FIG. 17 illustrates a side view of the shelf system 120 of FIG. 16 having the bottle 122 stored therein in an upright orientation, in accordance with an embodiment of the invention. As shown in FIG. 17, the shelf system 120 may include multiple shelves 200. Furthermore, the shelves 200 may each include rail mechanisms 202, a left lateral support 204, a right lateral support 206, a rear support 208, a transverse support 210, and medial supports 212. In some embodiments, the shelf 200, the rail mechanisms 202, the left lateral support 204, the right lateral support 206, the rear support 208, the transverse support 210, and the medial supports 212 of the embodiment of FIGS. 16 and 17 may be similar to the shelf 200, the rail mechanisms 202, the left lateral support 204, the right lateral support 206, the rear support 208, the transverse support 210, and the medial supports 212 of the embodiments of FIGS. 4-15.

As shown in FIGS. 16 and 17, the front portions 212*b* of the right-most medial supports 212 in each shelf 200, except the bottom shelf 200, have been removed from the cutout portions and the holes, of the back portions 212*a*, adjacent and in front of the transverse support 210, and have been reconnected to the back portions 212*a* via cutout portions and holes adjacent and behind the transverse support 210. By removing and reconnecting the front portions 212*b* in this manner, the bottle 122 may be placed on the bottom shelf in an upright orientation and may extend through each shelf 200.

As shown in FIG. 17, the front portions 212*b* of the right-most medial supports 212 in each shelf 200, after being reconnected to the back portions 212*a* via cutout portions and holes adjacent and behind the transverse support 210, extend downward toward the shelf 200 from which the front portions 212*b* were removed. Additionally, or alternatively, the front portions 212*b* extend into a channel 219 of the cutout portions adjacent and behind the transverse support 210 of the immediately below shelf. By extending into the channel 219 of the cutout portions adjacent and behind the transverse support 210 of the immediately below shelf, the front portions 212*b* may interact with the shelves below as further described herein with respect to FIGS. 18 and 19.

In some embodiments, the front portions 212*b* may connect to and/or interact with a shelf above or below the shelf 200 from which the front portions 212*b* were removed in a manner different from that described herein with respect to FIGS. 16 and 17. For example, the front portions 212*b* may connect to and/or interact with a shelf above or below the shelf 200 from which the front portions 212*b* were removed via another type of interference fit. As another example, the front portions 212*b* may connect to and/or interact with shelves above or below the shelves 200 from which the front portions 212*b* were removed by extending upward or downward and connecting to and/or interacting with the transverse supports 210 of the shelves above or below the shelves 200 from which the front portions 212*b* were removed.

FIGS. 18 and 19 illustrate perspective views of the shelf system 120 of FIGS. 16 and 17 having a bottle 122 stored therein in an upright orientation and having shelves 200 in an extended position and a stored position, respectively, in accordance with an embodiment of the invention. As shown in FIGS. 18 and 19, the bottle 122 may be placed on the bottom shelf of the shelf system 120 in an upright orientation, and other shelves of the shelf system 120 may support other bottles 122 oriented horizontally on the shelves (e.g., lying down on the shelves).

For example, a user may open one of the bottles 122 but not empty the entire contents of the bottle. To preserve the remaining contents of the bottle, the user may desire to store the opened bottle in the cabinet 100. The user may pull the shelves of the shelf system 120, which may extend outward via the rail mechanisms 202, to an extended position in which a portion of the shelves is beyond a front edge of the cabinet 100 and no longer within the interior of the cabinet 100. The user may remove front portions of one or more of the medial supports of the shelves and reconnect the front portions to back portions of the medial supports in a manner similar to that described herein with respect to FIGS. 10-17. By removing the front portions, the opened bottle may be placed on the bottom shelf of the shelf system 120 in an upright orientation, and the opened bottle may extend through the shelves of the shelf system 120.

Furthermore, after placing the opened bottle on the bottom shelf of the shelf system 120, the user may apply a force to one or more of the shelves of the shelf system 120 to push the shelves into the interior of the cabinet 100. When the user applies the force, each of the front portions of the medial supports that have been reconnected to back portions of the medial supports in a manner similar to that described herein with respect to FIGS. 10-17 may interact with and transfer the force applied by the user to the shelf below the shelf from which the front portion was removed. For example, and as described with respect to FIG. 17, the front portions may extend into a channel 219 of the cutout portions adjacent and behind the transverse support of the immediately below shelf. As another example, the front portions may connect to and/or interact with a shelf above or below the shelf from which the front portions were removed via another type of interference fit. As yet another example, the front portions may connect to and/or interact with shelves above or below the shelves from which the front portions were removed by extending upward or downward and connecting to and/or interacting with the transverse supports of the shelves above or below the shelves from which the front portions were removed. In this way, when the user applies the force, the shelves of the shelf system 120 move in unison, thereby preventing one of the shelves through which the opened bottle extends from impacting the opened bottle and/or tipping the opened bottle over. Thus, the user may safely push the shelves of the shelf system 120 from the extended position to the stored position within the interior of the cabinet 100.

In some embodiments, the cabinet 100 and/or the shelf system 120 may include fewer shelves or more shelves than the number of shelves shown in the figures. Additionally, or alternatively, a bottle may be placed in an upright orientation on a shelf other than the bottom shelf of the shelf system 120, and the front portions of the medial supports of the shelves through which the bottle extends may be removed to accommodate the upright bottle. Furthermore, in some embodiments, the bottle may be placed in an upright orientation on the interior surface of the bottom wall 108, and the front portions of the medial supports of the shelves through which the bottle extends may be removed to accommodate the upright bottle.

In some embodiments, rather than removing front portions of right-most medial supports, a user may remove front portions of other medial supports of shelves to accommodate an upright bottle. Additionally, or alternatively, to accommodate a width of the upright bottle, a user may remove front portions of multiple medial supports adjacent each other in each of the shelves of the shelf system 120.

Although FIGS. 10-19 and associated descriptions include the example embodiment of a shelf 200 as depicted in FIGS. 8-9, the features, functions, and descriptions may be applied to the example embodiment of a shelf 200 as depicted in FIGS. 4 and 5 and the example embodiment of a shelf 200 as depicted in FIGS. 6 and 7. Furthermore, the features, functions, and descriptions of FIGS. 10-19 and associated descriptions may also be applied to other example embodiments of shelves described herein and example embodiments of shelves including combinations of features of the example embodiments of shelves described herein.

Although FIGS. 1-19 depict medial supports that extend from a rear portion of a cabinet to a front portion of the cabinet, some embodiments may include medial supports that extend from a left portion of the cabinet to a right portion of the cabinet. In such embodiments, the transverse support may be offset from the right sidewall of the cabinet and/or the left sidewall of the cabinet, rather than being offset from the front edge of the cabinet. Furthermore, rather than a front portion of one or more of the medial supports being removable from a back portion, a left portion and/or a right portion of one or more medial supports may be removable and reconnectable to central portion of the medial supports in a manner similar to that described herein with respect to the front portions of the medial supports. Additionally, or alternatively, the left portion and/or the right portion may connect to and/or interact with another shelf below a shelf from which the left portion and/or the right portion was removed in a manner similar to that described herein with respect to the front portions of the medial supports.

In some embodiments, the front portions of the medial supports, after being connected to the back portions behind the transverse support to accommodate an upright bottle, may be removed from the back portions behind the transverse support and reconnected to the back portions in front of the transverse support (e.g., to support bottles stored in a horizontal orientation). In this way, the shelf system 120 may be converted from storing horizontal bottles to storing one or more upright bottles as well as horizontal bottles, and the shelf system 120 may be converted back to storing horizontal bottles.

Although many embodiments of the present invention have just been described above, the present invention may be embodied in many different forms and should not be construed as limited to the embodiments set forth herein; rather, these embodiments are provided so that this disclosure will satisfy applicable legal requirements. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more," even though the phrase "one or more" is also used herein. Like numbers refer to like elements throughout.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments may be configured without departing from the scope and spirit of the invention. Therefore, it is to be understood that, within the scope of the appended claims, the invention may be practiced other than as specifically described herein.

What is claimed is:

1. A cabinet for storage of beverage bottles, comprising:
- a door;
- a housing comprising a top wall, a bottom wall, a back wall, a left sidewall, a right sidewall, and a front edge, wherein the door is hingedly attached to the front edge of the housing, and wherein the top wall, the bottom wall, the back wall, the left sidewall, the right sidewall, and the door form an interior of the housing;
- a bottom shelf suspended above the bottom wall by at least one rail mechanism connected to the bottom shelf and the interior of the housing;
- a plurality of shelves suspended above the bottom shelf by rail mechanisms connected to the interior of the housing, wherein each shelf, of the plurality of shelves, comprises:
  - a rear support extending approximately from the left sidewall to the right sidewall in a rear portion of the interior;
  - a transverse support extending approximately from the left sidewall to the right sidewall, wherein the transverse support is offset from the front edge of the housing; and
  - multiple medial supports extending approximately from the front edge of the housing toward the back wall and supported by the rear support and the transverse support;
- wherein at least one shelf, of the plurality of shelves, comprises at least one medial support, of the medial supports, comprising:
  - a back portion extending from the rear support to the transverse support; and
  - a front portion extending from the transverse support toward the front edge of the housing, wherein the front portion is removable from the at least one shelf to accommodate storage of an upright container extending through the at least one shelf.

2. The cabinet of claim 1, wherein the front portion connects to the back portion via an interference fit.

3. The cabinet of claim 1, wherein, for each at least one medial support of each at least one shelf, the front portion is configured to, after being removed from the at least one shelf, connect to the back portion of the at least one medial support and another back portion of another medial support of another shelf, of the shelves or the bottom shelf, positioned below the shelf from which the front portion was removed.

4. The cabinet of claim 3, wherein, for each at least one medial support of each at least one shelf, the front portion is configured such that, after the front portion is removed from the at least one shelf and connected to the back portion of the at least one medial support and the other back portion of the other medial support of the other shelf, pulling one of the at least one shelf or the other shelf out of the interior of the housing causes the at least one shelf and the other shelf to be pulled out of the interior of the housing.

5. The cabinet of claim 1, comprising a refrigeration system and a controller for controlling the refrigeration system to maintain one or more target temperatures in the interior of the housing.

6. A shelf system for a cabinet, the shelf system comprising:

a plurality of shelves, wherein each shelf, of the shelves, comprises:

a left lateral support extending approximately from a front of the cabinet to a back of the cabinet;

a right lateral support extending approximately from the front of the cabinet to the back of the cabinet;

a rear support extending approximately from the left lateral support to the right lateral support in a rear portion of the cabinet;

a transverse support extending approximately from the left lateral support to the right lateral support, wherein the transverse support is offset from a front edge of the cabinet; and multiple medial supports extending approximately from the front of the cabinet to the back of the cabinet and supported by the rear support and the transverse support, wherein a medial support of the medial supports comprises:

a back portion extending from the rear support to the transverse support; and a front portion extending from the transverse support to the front edge of the cabinet, wherein the front portion is removable from the at least one shelf to accommodate storage of an upright container extending through the at least one shelf;

multiple left rail mechanisms each securing a left lateral support of the shelves to a left sidewall of the cabinet; and multiple right rail mechanisms each securing a right lateral support of the shelves to a right sidewall of the cabinet opposite the left sidewall of the cabinet.

7. The shelf system of claim 6, comprising a bottom shelf positioned below the shelves in the cabinet.

8. The shelf system of claim 6, wherein the medial support is a first medial support, and wherein each shelf, of the plurality of shelves, comprises a second medial support of the medial supports, and wherein the second medial support comprises:

a back portion extending from the rear support to the transverse support; and a front portion extending from the transverse support to the front edge of the cabinet, wherein the front portion is removable from the back portion.

9. The shelf system of claim 6, wherein each medial support, of the medial supports of each shelf of the plurality of shelves, comprises:

a back portion extending from the rear support to the transverse support; and a front portion extending from the transverse support to the front edge of the cabinet, wherein the front portion is removable from the back portion.

10. The shelf system of claim 6, wherein, for each shelf, of the plurality of shelves, the front portion of the medial support connects to the back portion via an interference fit.

11. The shelf system of claim 6, wherein, for each shelf, of the plurality of shelves, the front portion of the medial support is configured to, after being removed from the at least one shelf, connect to the back portion of the medial support and another back portion of another medial support of another shelf, of the plurality of shelves, positioned below the shelf from which the front portion was removed.

12. A shelf system for a cabinet, the shelf system comprising:

at least one shelf comprising:

a left lateral support extending approximately from a front of the cabinet to a back of the cabinet;

a right lateral support extending approximately from the front of the cabinet to the back of the cabinet;

a rear support extending approximately from the left lateral support to the right lateral support in a rear portion of the cabinet;

a transverse support extending approximately from the left lateral support to the right lateral support, wherein the transverse support is offset from a front edge of the cabinet; and a plurality of medial supports extending approximately from the front of the cabinet to the back of the cabinet and supported by the rear support and the transverse support, wherein a medial support of the medial supports comprises:

a back portion extending from the rear support to the transverse support; and a front portion extending from the transverse support to the front edge of the cabinet, wherein the front portion is removable from the at least one shelf to accommodate storage of an upright container extending through the at least one shelf.

13. The shelf system of claim 12, comprising:

a left rail mechanism securing the left lateral support to a left sidewall of the cabinet; and a right rail mechanism securing the right lateral support to a right sidewall of the cabinet opposite the left sidewall of the cabinet.

14. The shelf system of claim 13, wherein the left rail mechanism and the right rail mechanism permit the at least one shelf to move from a storage position within the cabinet to an extended position in which a portion of the at least one shelf extends beyond the front edge of the cabinet.

15. The shelf system of claim 12, wherein the medial support is a first medial support, wherein the at least one shelf comprises a second medial support of the plurality of medial supports, and wherein the second medial support comprises:

a back portion extending from the rear support to the transverse support; and a front portion extending from the transverse support to the front edge of the cabinet, wherein the front portion is removable from the back portion.

16. The shelf system of claim 12, wherein each medial support, of the plurality of medial supports, comprises:

a back portion extending from the rear support to the transverse support; and a front portion extending from the transverse support to the front edge of the cabinet, wherein the front portion is removable from the back portion.

17. The shelf system of claim 12, wherein the front portion of the medial support connects to the back portion via an interference fit.

18. The shelf system of claim 12, wherein the front portion of the medial support is configured to, after being removed from the at least one shelf, connect to the back portion of the medial support and another back portion of another medial support of another shelf positioned below the shelf from which the front portion was removed.

19. The shelf system of claim 12, comprising multiple shelves, wherein each shelf, of the multiple shelves, comprises at least one medial support comprising a removable front portion toward the front edge of the cabinet.

20. The shelf system of claim 12, wherein:

the at least one shelf comprises a front support extending from the left lateral support to the right lateral support;

the front support supports the medial supports;

the front portion, of the medial support, extends from the transverse support to the front support; and the front portion, of the medial support, is removable from the front support.

21. A shelf system for a cabinet, the shelf system comprising:

at least one shelf comprising:

a left lateral support extending approximately from a front of the cabinet to a back of the cabinet;

a right lateral support extending approximately from the front of the cabinet to the back of the cabinet;

a rear support extending approximately from the left lateral support to the right lateral support in a rear portion of the cabinet;

a transverse support extending approximately from the left lateral support to the right lateral support, wherein the transverse support is offset from a front edge of the cabinet; and a plurality of medial supports extending approximately from the front of the cabinet to the back of the cabinet and supported by the rear support and the transverse support, wherein a medial support of the medial supports comprises:

a back portion extending from the rear support to the transverse support; and a front portion extending from the transverse support to the front edge of the cabinet, wherein the front portion is removable from the back portion, and wherein the front portion is configured to, after being removed from a first position on the back portion, connect to the back portion of the medial support at a second position.

22. The shelf system of claim 21, wherein the front portion of the medial support is configured to, after being removed from the first position on the back portion, connect to another back portion of another medial support of another shelf positioned below the shelf from which the front portion was removed.

23. The shelf system of claim 22, wherein the front portion of the medial support is configured such that, after being removed from the first position on the back portion and connected to the back portion of the medial support at the second position and the other back portion of the other medial support of the other shelf, pulling one of the at least one shelf or the other shelf outward causes the at least one shelf and the other shelf to be pulled outward.

* * * * *